US010655556B2

(12) United States Patent
Nonaka et al.

(10) Patent No.: US 10,655,556 B2
(45) Date of Patent: May 19, 2020

(54) FUEL INJECTION DEVICE

(71) Applicant: ZAMA JAPAN KABUSHIKI KAISHA, Iwate (JP)

(72) Inventors: Takumi Nonaka, Iwate (JP); Hideki Watanabe, Iwate (JP)

(73) Assignee: ZAMA JAPAN KABUSHIKI KAISHA, Iwate (JP)

( * ) Notice: Subject to any disclaimer, the term of this patent is extended or adjusted under 35 U.S.C. 154(b) by 36 days.

(21) Appl. No.: 16/162,065

(22) Filed: Oct. 16, 2018

(65) Prior Publication Data

US 2019/0316541 A1 Oct. 17, 2019

Related U.S. Application Data

(63) Continuation of application No. 15/399,603, filed on Jan. 5, 2017, now Pat. No. 10,132,265, which is a (Continued)

(30) Foreign Application Priority Data

Feb. 16, 2010 (JP) ..... 2010-031585

(51) Int. Cl.
*F02D 41/34* (2006.01)
*F02M 51/08* (2006.01)
(Continued)

(52) U.S. Cl.
CPC ..... *F02D 41/345* (2013.01); *F02D 29/06* (2013.01); *F02D 41/30* (2013.01);
(Continued)

(58) Field of Classification Search
CPC ..... F02D 41/345; F02D 41/3005; F02D 41/3082; F02D 41/30; F02D 29/06;
(Continued)

(56) References Cited

U.S. PATENT DOCUMENTS 4,553,516 A * 11/1985 Hasegawa ..... F02D 29/06 123/438
5,090,386 A 2/1992 Kurosu et al.
(Continued)

FOREIGN PATENT DOCUMENTS

JP 61-272447 12/1986
JP 04-231641 8/1992
(Continued)

*Primary Examiner* — Joseph J Dallo
(74) *Attorney, Agent, or Firm* — One LLP

(57) ABSTRACT

A fuel injection device comprising electricity-generating means generating electricity by rotation of an engine and outputting a predetermined signal, and a solenoid valve injecting fuel; the valve being opened as a result of a drive current applied to a coil, and the fuel being injected into an intake passage of the engine at a predetermined timing during the rotation of the engine; to ensure that the flow rate required during high-speed operation ca be adequately provided in a fuel injection device for injecting/supplying fuel to an engine. The electricity-generating means is an alternating current generation means attached to the engine in a crank angle position at which an output is generated in synchronization with the intake timing of the engine; the signal is an injection command signal applied to the solenoid valve as an alternating-current drive current; and the applied voltage increases with increased engine speed.

13 Claims, 3 Drawing Sheets

Related U.S. Application Data continuation of application No. 14/546,468, filed on Nov. 18, 2014, now Pat. No. 9,581,117, which is a continuation of application No. 13/024,894, filed on Feb. 10, 2011, now Pat. No. 8,899,202.

(51) Int. Cl.
*F02D 29/06* (2006.01)
*F02M 51/06* (2006.01)
*F02D 41/30* (2006.01)

(52) U.S. Cl.
CPC ..... *F02D 41/3005* (2013.01); *F02D 41/3082* (2013.01); *F02M 51/061* (2013.01); *F02M 51/0678* (2013.01); *F02M 51/08* (2019.02); *F02D 2200/0404* (2013.01); *F02D 2200/101* (2013.01)

(58) Field of Classification Search
CPC ..... F02D 2200/101; F02D 2200/0404; F02M 51/08; F02M 51/061; F02M 51/0678
See application file for complete search history.

(56) References Cited

U.S. PATENT DOCUMENTS

| | | | | |
|---|---|---|---|---|
| 5,293,076 | A * | 3/1994 | Fukui | H02J 7/1476 290/40 C |
| 5,398,654 | A | 3/1995 | Niebrzydoski | |
| 5,476,082 | A | 12/1995 | Carpenter et al. | |
| 5,681,193 | A | 10/1997 | Pham et al. | |
| 6,273,065 | B1 | 8/2001 | Carpenter | |
| 6,581,581 | B1 | 6/2003 | Bebich | |
| 6,598,573 | B2 | 7/2003 | Kobayashi | |
| 6,868,832 | B2 | 3/2005 | Tamechika et al. | |
| 7,287,514 | B2 | 10/2007 | Kakinuma et al. | |
| 7,438,050 | B2 | 10/2008 | Allen | |
| 2002/0000791 | A1 | 1/2002 | Taniguchi et al. | |
| 2002/0113439 | A1* | 8/2002 | Thomas | F02D 31/001 290/40 A |
| 2003/0061870 | A1 | 4/2003 | Lodise et al. | |
| 2004/0020475 | A1 | 2/2004 | Hashimoto et al. | |
| 2008/0077285 | A1 | 3/2008 | Kumar et al. | |
| 2009/0013951 | A1 | 1/2009 | Nakata et al. | |
| 2009/0018750 | A1 | 1/2009 | Kadam et al. | |
| 2009/0064971 | A1 | 3/2009 | Ricco et al. | |
| 2011/0017165 | A1* | 1/2011 | Osawa | F02N 11/0818 123/179.4 |
| 2011/0197857 | A1* | 8/2011 | Nonaka | F02D 41/30 123/457 |
| 2013/0104851 | A1* | 5/2013 | Falkowski | F02D 41/32 123/446 |
| 2014/0152006 | A1* | 6/2014 | Sterregaard | B60W 10/08 290/7 |
| 2015/0167839 | A1* | 6/2015 | Nakamura | F02D 29/06 701/67 |

FOREIGN PATENT DOCUMENTS

| | | |
|---|---|---|
| JP | 11-107836 | 4/1999 |
| JP | 2001-193610 | 7/2001 |

* cited by examiner

FUEL INJECTION DEVICE

CROSS-REFERENCE TO RELATED APPLICATION

This application is a continuation of U.S. application Ser. No. 15/399,603, filed Jan. 5, 2017, which is a continuation of U.S. application Ser. No. 14/546,468, filed Nov. 18, 2014, now U.S. Pat. No. 9,581,117, which is a continuation of U.S. application Ser. No. 13/024,894, filed Feb. 10, 2011, now U.S. Pat. No. 8,899,202, which claims priority to Japanese Patent Application No. 2010-31585, filed Feb. 16, 2010, all of which are hereby incorporated by reference in their entirety.

BACKGROUND OF THE INVENTION

1. Field of the Invention

The present invention relates to a fuel injection device for injecting fuel into an intake passage of an engine, and specifically relates to a fuel injection device in which a solenoid valve opens with a predetermined timing based on an injection command signal that has been output in accordance with the crank angle position of the engine. The device is suitable for use in, for example, all-purpose engines used as sources of power in equipment such as agricultural, construction, and hand-held operating equipment, as well as small vehicles.

2. Description of the Related Art

Fuel injection devices that inject/supply pressurized fuel to the intake passage of an engine are well known, as described, for example, in JP (Kokai) 2001-193610. With this type of fuel injection device, a drive current computed by an electronic controller is applied as a fuel injection signal to the coil of a solenoid valve (injector) for each engine rotation, and a needle valve is raised while the fixed iron core is magnetized to open the valve and inject the fuel for a predetermined period of time.

FIG. 3 is a graph showing the relationship between engine speed and fuel flow rate in this type of fuel injection device. The graph shows that sufficient fuel can be supplied to achieve the required flow rate in an engine under conditions in which the engine speed is not high. It can also be seen, however, that a time lag between the start of the current flow and the reaching of the valve-opening voltage is created by the slow rise of the drive current because of the inductance in the coil of the solenoid valve.

This creates a problem in that the per-cycle effective injection time during which the solenoid valve opens and fuel is sprayed decreases with increased engine speed, that the injection period, even when set earlier, still does not match the supply of fuel, and the feed rate is insufficient relative to the flow rate required by the engine during high-speed operation, and that engine operation tends to be unbalanced.

In response to this problem, there is proposed in JP (Kokai) 11-107836 a fuel injection device provided with an alternating-current generator driven by engine rotation, and a rectifier for rectifying the motor output. These elements constitute a drive power-source circuit for increasing the magnitude of the drive voltage applied to the solenoid valve as the engine speed increases from start-up to high-speed operation. The device is further provided with an injector trigger circuit for allowing a drive current to flow from the drive power-source circuit to the solenoid valve.

Providing an alternating-current generator to the drive power-source circuit allows the drive voltage to be increased in accordance with increased engine speed, the opening of the solenoid valve to be accelerated, and a long effective injection time to be maintained. Consequently, it is possible to increase the fuel injection rate in accordance with increased engine speed and to more easily provide the flow rate required by the engine even during high-speed operation.

However, this fuel injection device requires that a rectifier, an injection trigger circuit, and an electronic controller as injection command generating means be placed between the alternating-current generator and the solenoid valve, and the final drive current is also output as a direct current. Consequently, using a higher voltage for the drive current fails to achieve a substantially rapidly rising voltage, and the effect of reducing the injection delay time is insufficient. In addition, increasing the number of parts that constitute the fuel injection device makes the device configuration more complicated and tends to increase costs.

The present invention is aimed at resolving the aforementioned problems and providing a fuel injection device for injecting/supplying fuel to an engine inexpensively and at the fuel flow rate required for high-speed operation.

SUMMARY OF THE INVENTION

The present invention is a fuel injection device comprising electricity-generating means for generating electricity by the rotation of an engine and outputting a predetermined signal, and a solenoid valve for injecting fuel, the valve being opened as a result of a drive current being applied to a coil, and the fuel being injected into an intake passage of the engine at a predetermined timing during the rotation period of the engine, wherein the electricity-generating means is an alternating-current generator having an electromotive coil at a predetermined position on the external periphery of a flywheel disposed on an engine shaft and provided with a magnet in an area along the edge; the electromotive coil is disposed at a predetermined position along the external periphery of the flywheel in a crank angle position at which an output is generated in synchronization with the intake timing of the engine used; the electricity-generating means is attached to the engine in a crank angle position at which the output signal is output in synchronization with the engine intake timing; the signal is an injection command signal applied to the solenoid valve as an alternating-current drive current; and the applied voltage increases with increased engine speed.

Electricity generating means for outputting a signal based on engine rotation is thus used as an alternating-current generator, and the voltage of the output signal increase with increased engine speed, whereby the rising of the voltage is accelerated with increased voltage, making it possible to reduce the time from the start of output to when the injection start voltage is reached. Furthermore, using this signal as the drive current of the solenoid valve eliminates the need to provide intermediately positioned electronic controllers and other components, reduces the injection start period, and makes it easier to ensure the flow rate required by the engine during high-speed operation.

According to another aspect of the fuel injection device, a fuel flow-rate adjustment valve is provided to a fuel passage that extends to the solenoid valve or to a fuel passage that extends from the solenoid valve to the intake passage; an intake passage having a throttle valve is configured as a through passage; the fuel flow-rate adjustment valve operates so as to increase the fuel flow rate in association with the opening operation of the throttle valve; and the per-cycle fuel injection rate increases with increased engine speed, making it easier to provide the flow rate required by the engine during high-speed operation.

According to yet another aspect of the fuel injection device, a fuel pump operated by the introduction of a pulsating motion from the engine is provided for pumping fuel to the solenoid valve, and the fuel pump increases the discharge pressure as the engine speed increases, making it easier to increase the fuel injection rate even when an increase in the engine speed contracts the injection period and makes it impossible to provide a sufficiently effective injection time.

In accordance with the present invention, the electricity-generating means for outputting a signal in accordance with engine rotation is an alternating current generator, and the output signal is applied directly to a solenoid valve as a drive current, making it possible to reduce costs and to provide the flow rate required during high-speed operation.

DESCRIPTION OF THE PREFERRED EMBODIMENTS

Embodiments of the invention are described below in reference to the drawings.

Figure 1:
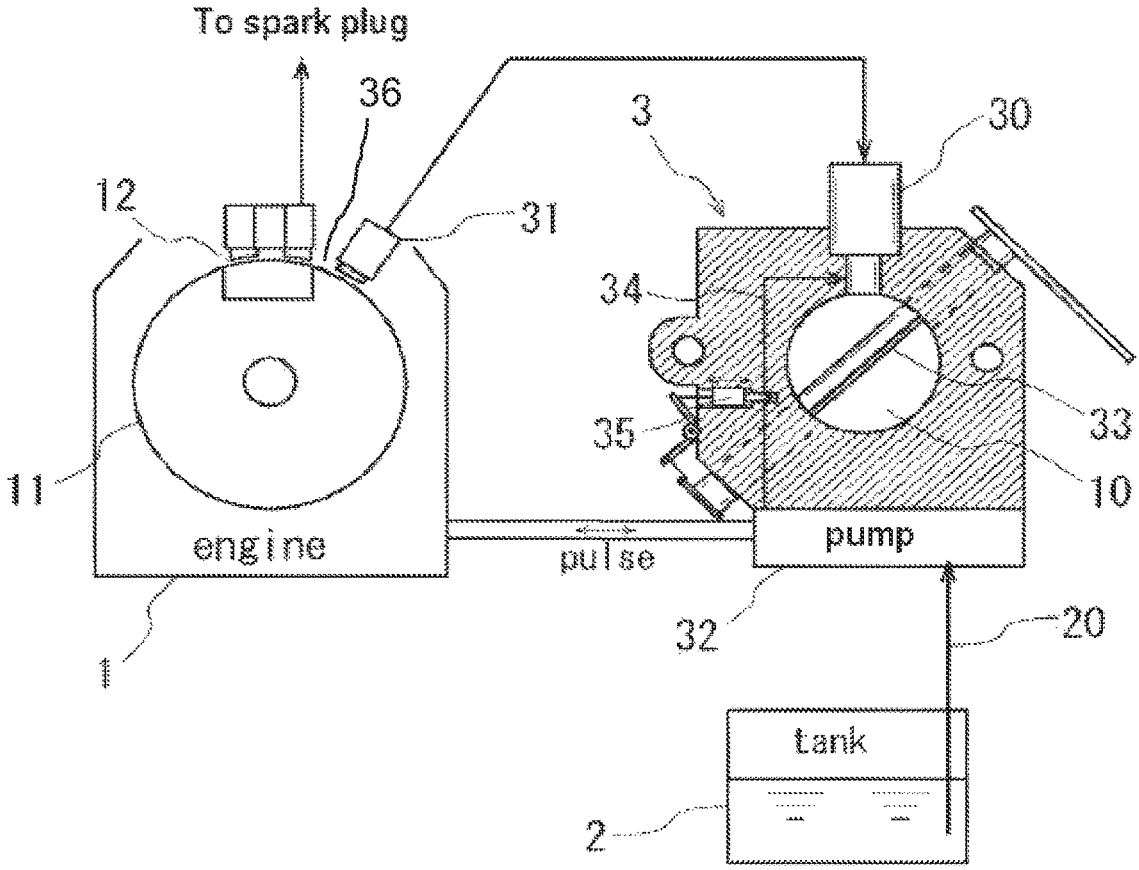
FIG. 1 is a layout diagram of the fuel supply system for an engine provided with a fuel injection device as an embodiment of the present invention.

FIG. 1 shows the configuration of the fuel supply system of an engine 1 provided with a fuel injection device 3 of the present embodiment. A fuel supply passage 20 that leads from a fuel tank 2 is connected to the fuel injection device 3 arranged so as to constitute a portion of the intake passage 10 of the engine 1, and fuel is injected and supplied by a solenoid valve 30 whose injection opening side is exposed to the intake passage 10.

A fuel pump 32 having a fuel compression chamber that is partitioned with a diaphragm (not shown) is mounted on the fuel injection device 3. Fuel is pressurized by the introduction of a pulsating pressure from the engine 1 to the backpressure chamber, and is supplied to the solenoid valve 30 via a high-pressure fuel passage 34. This configuration is the same as the conventional example.

A feature of the present invention is that an alternating-current generator 36 is used as electrical generation means operated by the rotation of the engine 1 and caused to output an injection command signal based on the injection period. The output signal is used as an injection command signal and is directly input as the drive current of the solenoid valve 30. There is no need to provide intermediately positioned parts such as an electronic controller, an injector trigger circuit, or a rectifier, and the flow rate required by the engine during high-speed operation can be achieved in a simple configuration and at a low cost.

In the present embodiment, the alternating-current generator 36 comprises an ignition coil flywheel 11 in which a magnet 12 is disposed along part of the edge area in the engine 1, and an electromotive coil 31 provided at a predetermined location at the outer periphery of the flywheel. The electromotive coil 31 is positioned so as to match the engine used and to provide a crank angle position capable of generating an output in synchronization with the intake timing. The output signal is input directly to the solenoid valve 30, dispensing with the need to calculate the fuel injection period by the electronic controller.

Figure 2:
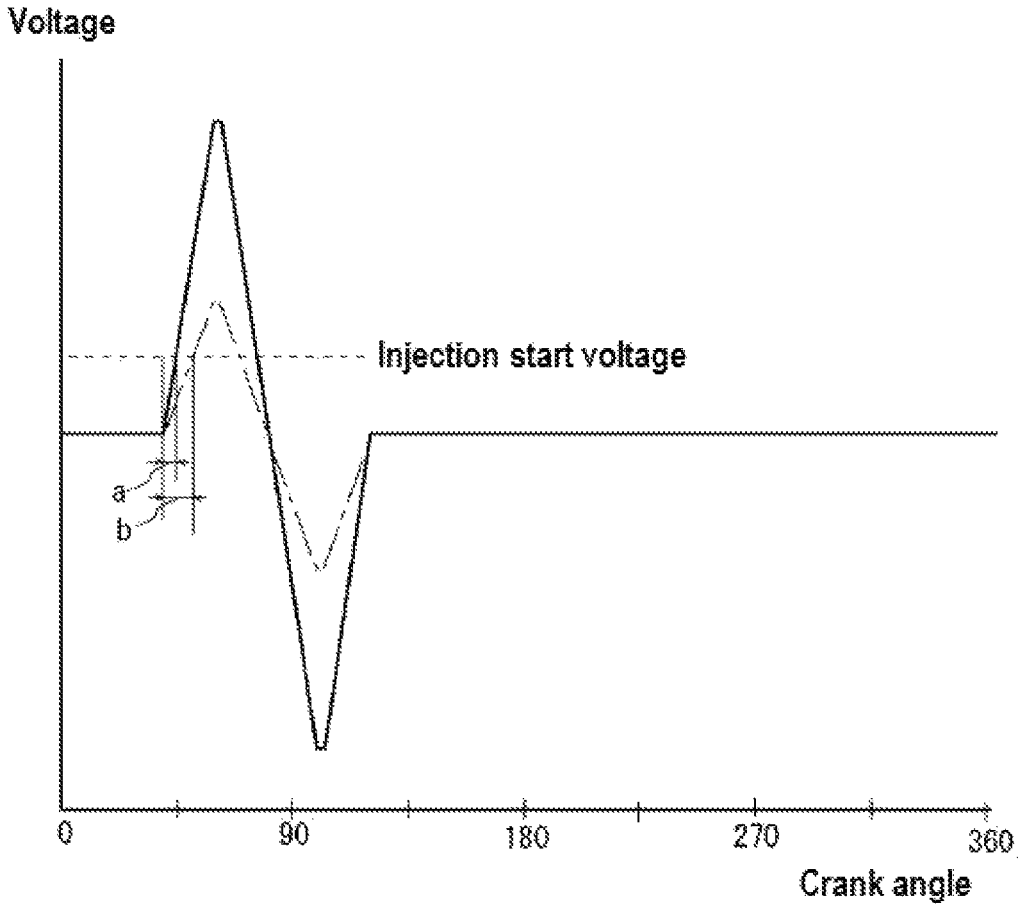
FIG. 2 is a graph showing the changes in drive voltage brought about by the fuel injection device of FIG. 1.
Figure 3:
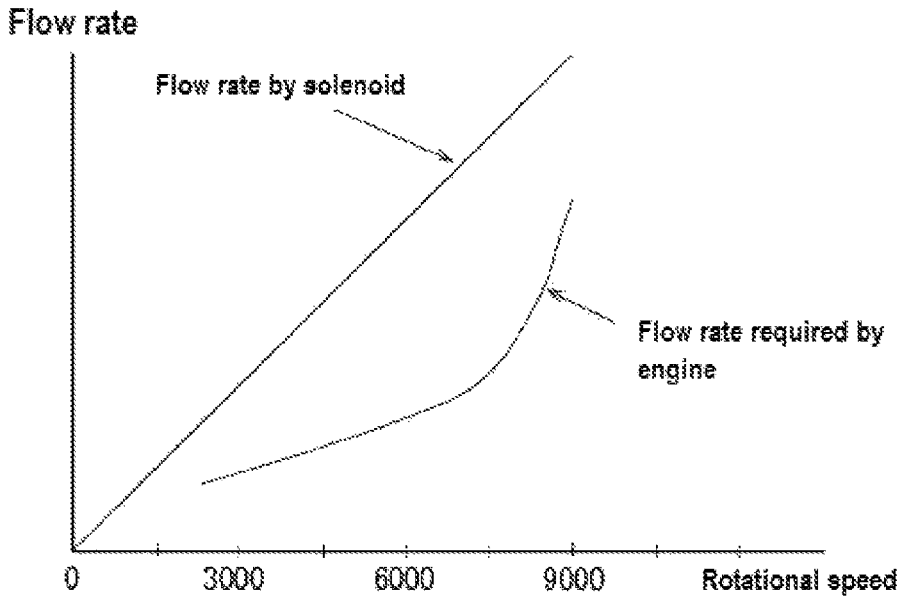
FIG. 3 is a graph showing the relationship between the fuel flow rate produced by the solenoid and the flow rate required by the engine in a typical fuel injection device.

In addition, the alternating-current generator 36 has an electromotive coil at a predetermined location on the external periphery of the flywheel 11. The drive voltage of the alternating current output increases and the rise becomes more rapid with increased engine speed and a faster movement of the flywheel 11 past the magnet 12. For this reason, the angle (time) "a" based on the drive voltage during high-speed operation (indicated by the solid line) is smaller (shorter) than the angle (time) "b" from the start of input to the injection start voltage based on the drive voltage during low speeds (indicated by the dotted-dashed line), as shown in the graph of FIG. 2.

The lift speed of the valve increases and the valve opening (stroke) becomes larger with increased drive voltage. The time during which the valve is open is therefore effectively determined not by the length of the drive current, but by the height of the peak voltage, and the fuel injection rate can be increased by increasing the valve opening time. Accordingly, the flow rate required by the engine during high-speed operation can be provided and the fuel injection time does not need to be computed using an electronic controller.

Moreover, a throttle valve 33 is attached to the fuel injection device 3 in the present embodiment, and a needle-valve fuel-flow adjustment valve 35 is disposed in the high-pressure fuel passage 34 that extends from the fuel pump 32 to the solenoid valve 30. Thus, a link mechanism for lifting the needle valve is provided to the fuel-flow adjustment valve 35 so that the fuel flow rate increases in conjunction with the opening operation of the throttle valve 33, and the fuel rate increases in accordance with the increase in the flow rate required by the engine during high-speed operation.

With the fuel pump 32 operated by the introduction of a pulsating pressure from the engine 1, it is recommended that the discharge pressure be increased with increased engine speed by varying the spring pressure of the diaphragm, the displacement width of the diaphragm, or the like in accordance with the throttle valve aperture. This allows the fuel injection rate to be increased with ease by increasing fuel pressure, even under conditions in which the engine speed is increases, the injection gap is reduced, and the effective injection time is less likely to be extended.

The present embodiment was described with reference to a fuel-passage fuel injection device in which a fuel-flow adjustment valve is disposed in a fuel passage that extends to a solenoid valve, but the invention can be implemented in a similar manner with a fuel-passage fuel injection device in which the fuel-flow adjustment valve is disposed in the fuel passage that extends from the solenoid valve to the intake passage.

As described above, the present invention, which has a simple configuration and only a small number of parts, is applied to a fuel injection device for injecting/supplying fuel to an engine, whereby the flow rate required during high-speed operation can be provided at a low cost.

KEY

1 Engine
2 Fuel tank

3 Fuel injection device
10 Intake passage
11 Fly wheel
30 Solenoid valve
31 Electromotive coil
32 Fuel pump
33 Throttle valve
34 High-pressure fuel passage
35 Fuel-flow adjustment valve
36 Alternating-current generator

What is claimed is:

1. A method for injecting fuel comprising the steps of:

generating a predetermined signal as a function of the rotation of an engine with an alternating-current generator, and injecting fuel from a solenoid valve into an intake passage of the engine at a predetermined timing during the rotation period of the engine in response to the predetermined signal.

2. The method of claim 1, wherein the predetermined signal is an injection command signal comprising an alternating-current drive current.

3. The method of claim 2, wherein the step of injecting fuel from the solenoid valve includes applying the drive current to a coil of the solenoid valve.

4. The method of claim 1, wherein the step of generating the predetermined signal includes generating the predetermined signal in synchronization with an intake timing of the engine.

5. The method of claim 3, wherein the step of applying the drive current to the coil includes applying the predetermined signal to the coil without modification.

6. The method of claim 1, wherein the alternating-current generator having an electromotive coil at a predetermined position on the external periphery of a flywheel disposed on an engine shaft and provided with a magnet in an area along the edge.

7. The method of claim 6, wherein the electromotive coil is disposed at a predetermined position along the external periphery of the flywheel in a crank angle position at which an output signal is generated in synchronization with the intake timing of the engine.

8. The method of claim 3, wherein an applied voltage increases with increased engine speed.

9. The method of claim 1, wherein per-cycle fuel injection rate increases with increased engine speed.

10. The method of claim 1, further comprising the step of adjusting the fuel flow rate through a fuel flow-rate adjustment valve in association with the operation of a throttle valve.

11. The method of claim 10, wherein the fuel flow-rate adjustment valve is provided to a fuel passage that extends to one of the solenoid valve or a fuel passage that extends from the solenoid valve to the intake passage, wherein the intake passage is configured as a through passage having the throttle valve positioned therein.

12. The method of claim 1, further comprising the step of pumping fuel to the solenoid valve by the introduction of a pulsating motion from the engine.

13. The method of claim 12, wherein the pressure of the fuel pumped to the solenoid valve increases as the engine speed increases.

* * * * *